United States Patent [19]

Shiozaki et al.

[11] 4,336,307

[45] Jun. 22, 1982

[54] HOLLOW WATER ABSORBING POLYESTER FILAMENTS AND A PROCESS FOR PRODUCING THE SAME

[75] Inventors: Masahiro Shiozaki; Kiyoshi Nawata, both of Matsuyama; Osamu Wada, Takatsuki; Kiyokazu Tsunawaki, Matsuyama; Takatoshi Kuratsuji, Matsuyama; Wataru Funakoshi, Matsuyama; Togi Suzuki, Matsuyama, all of Japan

[73] Assignee: Teijin Limited, Osaka, Japan

[21] Appl. No.: 168,529

[22] Filed: Jul. 14, 1980

Related U.S. Application Data

[63] Continuation of Ser. No. 6,128, Apr. 24, 1979, abandoned.

[30] Foreign Application Priority Data

Jan. 27, 1978 [JP] Japan ..... 53-7156

[51] Int. Cl.[3] ..... B29H 7/20; D02G 3/00

[52] U.S. Cl. ..... 428/398; 264/49; 264/561; 264/209.1; 264/211; 264/344

[58] Field of Search ..... 428/398; 264/177 F, 264/561, 41, 209.1, 49, 344, 211

[56] References Cited

U.S. PATENT DOCUMENTS

| | | | |
|---|---|---|---|
| 3,135,813 | 6/1964 | Speakman | 428/398 |
| 3,493,459 | 2/1970 | McIntosh et al. | 428/398 |
| 3,558,420 | 1/1971 | Opfell | 428/398 |
| 3,682,846 | 8/1972 | Sano et al. | 264/49 |
| 3,772,137 | 11/1973 | Tolliver | 428/398 |
| 4,046,843 | 9/1977 | Sano et al. | 264/344 |
| 4,171,987 | 10/1979 | Horiguchi et al. | 264/49 |
| 4,182,582 | 1/1980 | Youval et al. | 264/49 |

FOREIGN PATENT DOCUMENTS

| | | | |
|---|---|---|---|
| 48-27608 | 8/1973 | Japan | 264/177 F |
| 48-75894 | 10/1973 | Japan | 264/78 |

*Primary Examiner*—Jay H. Woo

*Attorney, Agent, or Firm*—Burgess, Ryan and Wayne

[57] ABSTRACT

Hollow water-absorbing polyester filaments, each having fine pores evenly distributed throughout the filament and extending approximately in parallel to the filament axis, are produced by melt-spinning a blend of a polyester and a pore-forming agent consisting of at least one sulfonate compound of the formula:

$$R'SO_3M'$$

wherein R′ is an alkyl radical having 3 to 30 carbon atoms or an aryl or alkylaryl radical having 7 to 40 carbon atoms and M′ is an alkali or alkaline earth metal, and by removing at least a portion of the sulfonate compound from the hollow filaments by using an alkali aqueous solution so as to cause a number of fine pores to be formed in the hollow filaments and to cause each hollow to be connected to the outside of the filament through the fine pores.

25 Claims, 8 Drawing Figures

×3000 x 3000 x 3000 x 3000 x 3000 x 3000 x 3000 x 3000 x 3000

HOLLOW WATER ABSORBING POLYESTER FILAMENTS AND A PROCESS FOR PRODUCING THE SAME

This is a continuation of application Ser. No. 6,128, filed Jan. 24, 1979 now abandoned

FIELD OF THE INVENTION

The present invention relates to hollow water absorbing polyester filaments and a process for producing the same. More particularly, the present invention relates to hollow polyester filaments each containing a number of fine pores through which the hollow is connected to the outside of the filament and each exhibiting an excellent water and moisture absorbing property, and also relates to a process for producing the same.

BACKGROUND OF THE INVENTION

Polyalkylene terephthalates are widely usable in various resin industries due to their excellent physical and chemical properties. Especially, the polyester is highly useful for producing synthetic filaments or fibers which are also useful in various fields. However, since the polyester per se is highly hydrophobic, the polyester filaments are also hydrophobic and not at all suitable for use as filaments exhibiting a water and moisture absorbing property.

In order to obtain polyester filaments exhibiting a hydrophilic property, attempts were made to modify the known polyester filaments by producing them from a blend of a polyester with a polyalkylene glycol (U.S. Pat. No. 3,329,557 and British Pat. No. 956,833) or from a mixture of a polyalkylene glycol with a metal salt derivative (U.S. Pat. No. 3,682,846). However, the hydrophilic property of such resultant polyester filaments was found to be not only unsatisfactory but also readily degraded when the polyester filaments were laundered. In addition, the above-mentioned modification was found to cause the resultant polyester filaments to exhibit decreased physical properties, especially decreased resistance to actinic rays and a decreased thermal resistance.

In order to eliminate the disadvantages of the above-mentioned modification, attempts were made to treat the modified polyester filaments in a hot water medium or a hot alkali aqueous solution so as to form wrinkle-shaped thin concaves on the surfaces of the filaments. However, the treated polyester filaments were still found to have an unsatisfactory level of water and moisture absorbing property. Also, such treatment resulted in a decrease in the physical properties, especially, the tensile strength, of the resultant polyester filaments.

SUMMARY OF THE INVENTION

The object of the present invention is to provide hollow polyester filaments having an excellent long-lasting water and moisture absorbing property and a satisfactory tensile strength, and to provide a process for producing such filaments which does not degrade the other physical properties of the filaments.

The above-mentioned object can be attained by the hollow polyester filaments of the present invention which consist essentially of a polyester having at least 90% by molar amount of recurring units of the formula (I):

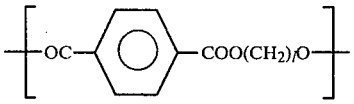

(I)

wherein l represents an integer of 2 to 6, and wherein each of the filaments has at least one hollow extending along the longitudinal axis of the filament and a number of fine pores evenly distributed throughout the filament and extending approximately in parallel to the longitudinal axis of the filament, the hollow being connected to the outside of the filament at least through the portions of the fine pores which are connected to each other. The above-mentioned hollow water-absorbing polyester filaments can be produced by the process of the present invention which comprises the steps of preparing hollow polyester filaments each having at least one hollow extending along the longitudinal axis of the filament, by melt-spinning a blend of a polyester containing at least 90% by molar amount of recurring units of the formula (I):

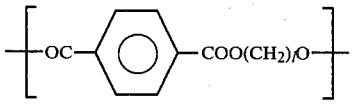

(I)

wherein l represents an integer of from 2 to 6, and a pore-forming agent consisting of at least one organic sulfonate compound of the formula (III):

$$R'SO_3M' \qquad \text{(III)}$$

wherein R′ represents a member selected from the group consisting of alkyl radicals having 3 to 30 carbon atoms, aryl radical having 7 to 40 carbon atoms, and M′ represents a member selected from the group consisting of alkali metals and alkaline earth metals, and; removing at least a portion of the organic sulfonate compound from the resultant hollow polyester filaments by treating them with an alkali aqueous solution to cause each of the hollow polyester filaments to have a number of fine pores which are evenly distributed throughout the filament and extending approximately in parallel to the longitudinal axis of the filament, and to cause the hollow to be connected to the outside of the filament at least through the portions of the fine pores which are connected to each other.

DETAILED DESCRIPTION OF THE INVENTION

Figure 1:
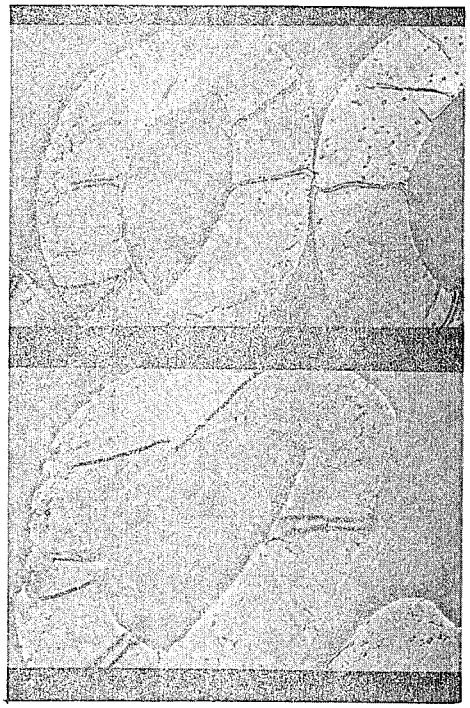
FIG. 1 is an electron microscope view of cross-sections of hollow polyester filaments of the present invention at a magnification of 3000.

The hollow polyester filaments of the present invention consist essentially of a polyester having at least 90% by molar amount of recurring units of the formula (I):

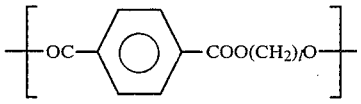

(I)

wherein l represents an integer of 2 to 6. That is, the recurring units of the formula (I) consists of a terephthalic acid moiety and an alkylene glycol moiety containing 2 to 6 carbon atoms. The alkylene glycol may be selected from ethylene glycol, trimethylene glycol, tetramethylene glycol, pentamethylene glycol and hexamethylene glycol. The preferable alkylene glycol is either ethylene glycol or tetramethylene glycol. That is, it is preferable that the polyester be either polyethylene terephthalate or polybutylene terephthalate.

In the polyester usable for the present invention may contain at least one di-functional carboxylic acid moiety as an additional moiety to the terephthalic acid moiety. The di-functional carboxylic acid may be derived from the compound selected from aromatic carboxylic acids such as isophthalic acid, naphthalene di-carboxylic acid, diphenyldicarboxylic acid, diphenoxyethane dicarboxylic acid, $\beta$-hydroxyethoxy benzoic acid and p-hydroxybenzoic acid; aliphatic carboxylic acids such as sebacic acid, adipic acid and oxalic acid; and cycloaliphatic dicarboxylic acids such as 1,4-cyclohexane dicarboxylic acid.

The polyester usable for the present invention may contain at least one diol moiety as additional moiety to the alkylene glycol moiety. The diol moiety may be derived from aliphatic, cycloaliphatic and aromatic diol compounds such as cyclohexane-1,-4-dimethanol, neopentyl glycol, bisphenol A and bisphenol S.

The polyester usable for the present invention can contain, in additional to the recurring units of the formula (I), at least one other additional moiety of the formula (II):

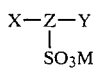

(II)

wherein X and Y represent a member selected from the class consisting of a hydrogen atom and the groups of

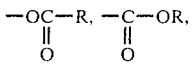

$$-(CH_2)_n-OH,\ -O(CH_2)_n-[O(CH_2)_n]_m-OH \text{ and}$$

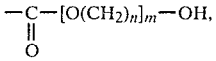

in wherein R represents either a hydrogen atom or a lower alkyl radical having 1 to 10 carbon atoms, respectively, when either one of X and Y represents a hydrogen atom, the other represents one of the above-mentioned groups; Z represents either an aromatic hydrocarbon or an aliphatic hydrocarbon; n and m represent an integer, respectively, and M represents either an alkali metal or alkaline earth metal.

The additional moiety of the formula (II) may be derived from the copolymerization compound selected from the class consisting of sodium 3,5-di(carbomethoxy)benzene sulfonate, potassium 3,5-di(carbomethoxy)benzene sulfonate, sodium 3,5-di(carboethoxy)benzene sulfonate, potassium 3,5-di(carboethoxy)benzene sulfonate, sodium 1,8-di(carbomethoxy)naphthalene-3 sufonate, potassium 1,8-di(carbomethoxy)naphthalene-3-sulfonate, sodium 2,6-di(carbomethoxy)-naphthalene-1-sulfonate, potassium 2,6-di(carbomethoxy)-naphthalene-1-sulfonate, sodium 2,6-di(hydroxyethoxy)benzene sulfonate, potassium 2,6-di(hydroxyethoxy)benzene sulfonate, sodium phenolsulfonate and lithium carbomethoxybenzene sulfonate.

In the additional moiety of the formula (II), it is preferable that X and Y represent a group —COOR' wherein R' represents a member selected from the group consisting of a hydrogen atom and methyl and ethyl radicals, respectively, Z represents either a benzene radical or a naphthalene radical, and M represents either a sodium or a potassium atom. In this case, the preferable additional moiety may be derived from the copolymerization compound selected from the class consisting of sodium 3,5-di(carbomethoxy)-benzene sulfonate, sodium 3,5-di(carboethoxy)benzene sulfonate, potassium 3,5-di(carbomethoxy)benzene sulfonate, potassium 3,5-di(carboethoxy)benzene sulfonate, sodium 2,6-di(carbomethoxy)naphthalene-1-sulfonate, sodium 2,6-di-(carboethoxy)naphthalene-1-sulfonate and potassium 2,6-di-(carbomethoxy)naphthalene-1-sulfonate.

In the polymerization process for producing the polyester, the above-mentioned copolymerization compounds can be added into the polymerization mixture before the start of the polymerization or at any stage from the start to the end of the polymerization process. However, it is preferable that the copolymerization compound be added into the polymerization mixture before the start of the polymerization process.

In the polyester usable for the present invention, it is preferable that the additional moiety of the formula (II) be present in a molar amount of from 0.01 to 10%, more preferably, from 0.5 to 6%, in the polyester.

The additional moiety of the formula (II) is effective not only for increasing the water and moisture absorbing property of the resultant hollow polyester filaments but also for improving the dyeing property of the polyester filaments.

Furthermore, the polyester may contain a further additional tri-functional moiety as long as the resultant condensation product has a substantial thermoplastic property. The tri-functional compound can be selected from trimellitic acid, glycerol and pentaerythritol. Furthermore, the polyester may contain a further additional mono-functional moiety as long as the resultant condensation product has a satisfactorily high degree of polymerization. The mono-functional compound may be, for example, benzoic acid.

The polyester usable for the present invention can be prepared by any conventional processes.

For example, in the case of polyethylene terephthalate, a terephthalic ethylene glycol ester or a lower polymerization product thereof is prepared by directly esterifying the terephthalic acid with ethylene glycol, or by ester-exchanging a lower alkyl ester of terephthalic acid, for example, dimethyl terephthalate, with ethylene glycol, or by reacting terephthalic acid with ethyleneoxide, and then the ester or the lower polymerization product thereof is condensed under a reduced pressure at an elevated temperature to provide the polyethylene terephthalate having a desired degree of polymerization. The above-mentioned reactions may be carried out in the presence of one or more members selected from the above-mentioned additional compounds and from the further additional compounds.

Each individual polyester filament of the present invention contains at least one hollow extending along the longitudinal axis of the filament. In the most preferable embodiment, the polyester filament of the present invention has a single hollow which is located in the center portion of the filament and which extends along the longitudinal axis of the filament. However, the polyester filament can contain two or more, preferably, two to four, hollows. The cross-sectional profile of the polyester filament of the present invention is not limited to a special shape. That is, the cross-sectional profile may exhibit a regular shape(round) or a irregular shape, for example, a multilobal shape. Also, the cross-sectional profile of the hollow may be either a regular or an irregular shape. That is, in a well-known example, the cross-sectional profiles of both the filament and the hollow exhibit circular shapes. In another example, the filament exhibits a tri-lobal cross-sectional profile and the hollow has a round-shaped cross-sectional profile. In a further example, the filament has a round-shaped cross-sectional profile and the hollow exhibits a multilobal cross-sectional profile. In a yet further example, the filament and the hollow can exhibit similar or different cross-sectional profiles.

The diameter of the hollow polyester filament is not limited to a special upper limit value.

In the hollow polyester filaments of the present invention, it is preferable that the total cross-sectional area of the hollow or hollows in each individual filament corresponds to from 5 to 50%, more preferably, from 10 to 30%, of the entire cross-sectional area of the filament inclusive of the hollow or hollows. When the total cross-sectional area of the hollow or hollows is larger than 50% of the cross-sectional area of the filament, the portion of the filament body surrounding each hollow has a very small thickness which causes the production of the filament to be very difficult. Also, the small hollow having a cross-sectional area corresponding to less than 5% of the cross-sectional area of the filament causes the resultant filament to exhibit a poor water and moisture absorbing property.

In the hollow polyester filaments of the present invention, it is important that, in each individual filament body, a number of fine pores are evenly distributed and extend approximately in parallel to the longitudinal axis of the filament. Also, it is important that portions of the fine pores be connected to each other so as to cause the hollow to be connected to the outside of the filament through the fine pores. If the fine pores are distributed locally in the filament, it is difficult to connect the hollow uniformly to the outside of the filament through the fine pores. A disconnection or poor connection between the hollow and the outside of the filament causes the filament to have a poor water and moisture absorbing property. Also, the local distribution of the fine pores in the filament causes the filament to exhibit a decreased mechanical property such as a decreased tensile strength.

Referring to FIG. 1, the polyester filament has an annular cross-section in which a hollow is surrounded by an annulus. The annular cross-section of the filament exhibits a number of fine pores which are distributed evenly throughout the annular cross-section of the filament.

Figure 2:
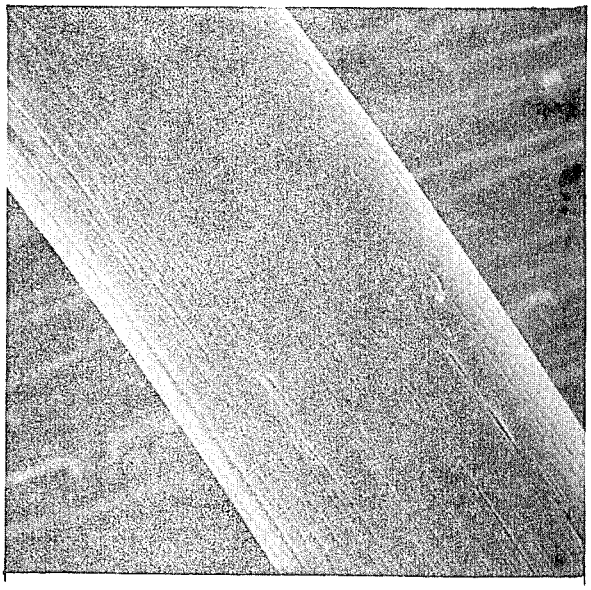
FIG. 2 is an electron microscope view of a peripheral surface of a hollow polyester filament of the present invention at a magnification of 3000.
Figure 3:
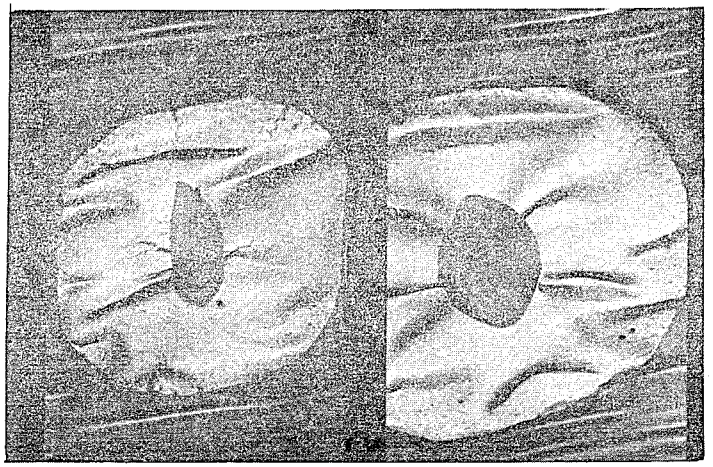
FIG. 3 is an electron microscope view of a cross-section of a hollow polyester filament consisting of a known polyester composition at a magnification of 3000.
Figure 4:
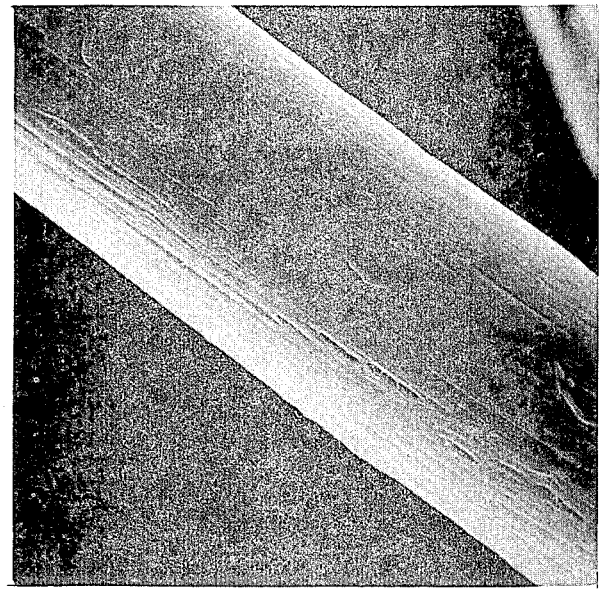
FIG. 4 is an electron microscope view of a peripheral surface of the hollow polyester filament as shown in FIG. 3.
Figure 5:
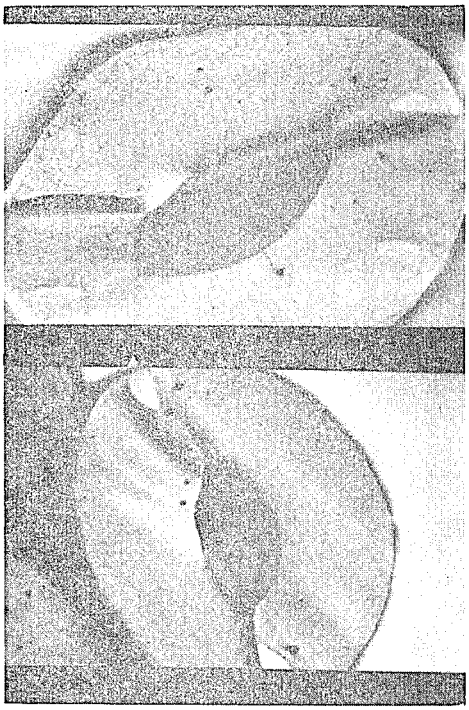
FIG. 5 is an electron microscope view of a cross-section of a hollow polyester filament consisting of another known polyester composition at a magnification of 3000.
Figure 6:
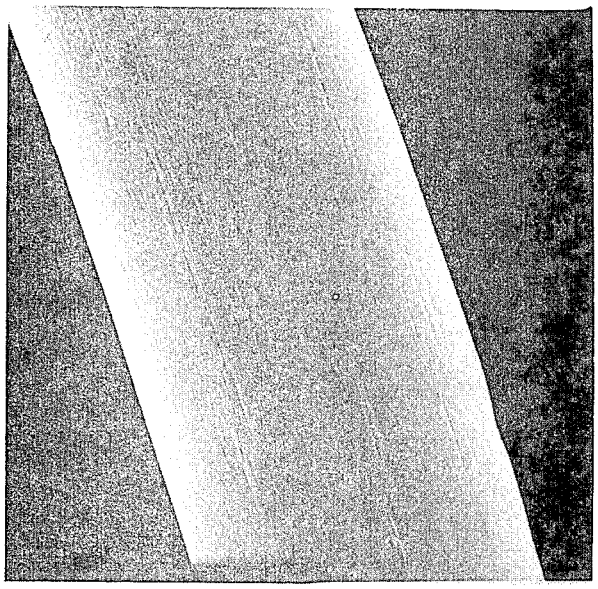
FIG. 6 is an electron microscope view of a peripheral surface of the hollow polyester filament shown in FIG. 5 at a magnification of 3000.
Figure 7:
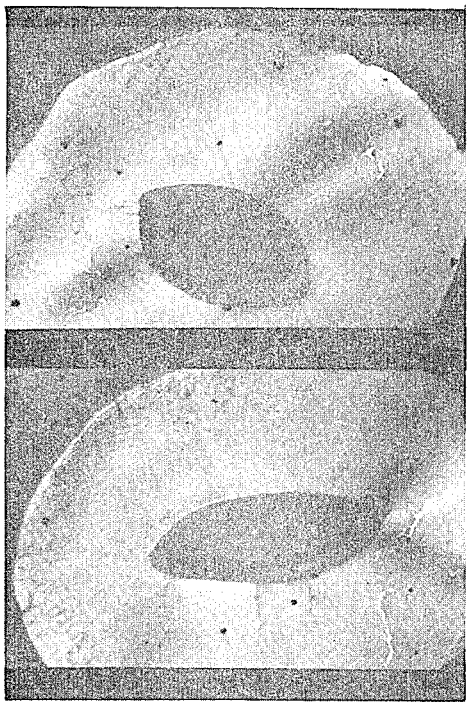
FIG. 7 is an electron microscope view of a cross-section of a hollow polyester filament consisting of still another known polyester composition at a magnification of 3000; and, FIG. 8 is an electron microscope view of a peripheral surface of the hollow polyester filament shown in FIG. 7 at a magnification of 3000.
Figure 8:
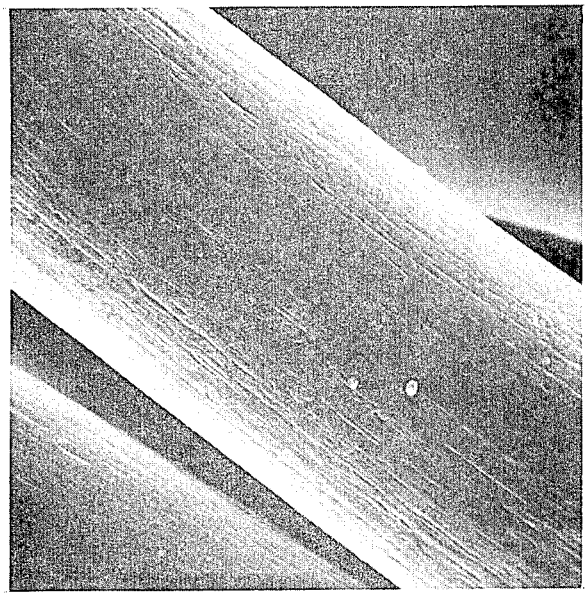

Referring to FIG. 2, it is clear that a number of fine pores extend approximately in parallel to the longitudinal axis of the filament. Also, FIG. 2 shows that some of the fine pores have very fine holes through which the pores are connected to each other. Accordingly, the hollow can be connected to the outside of the filament through portions of the fine pores. It is preferable that the diameters of the fine pores be in a range of from 0.001 to 5 microns, more preferably, from 0.01 to 1 micron. If the fine pores have on the average a diameter smaller than 0.001 micron, the hollow polyester filaments sometimes have a poor water and moisture absorbing property. Also, a diameter larger than 5 microns sometimes might cause the polyester filaments to have a poor mechanical strength. Also, it is preferable that the lengths of the fine pores be in a range of from 0.01 to 200 microns, more preferably, from 0.1 to 100 microns. Furthermore, it is preferable that the total sum of the cross-sectional areas of the fine pores corresponds to from 0.01 to 50%, more preferably, from 0.1 to 30%, of the cross-sectional area of the filament exclusive of the hollow. A total sum larger than 50% will cause the filament to have a poor mechanical strength, and a total sum smaller than 0.01% will cause the filament to have a poor water and moisture absorbing property of the filament. Usually, the hollow polyester filaments of the present invention preferably have a tensile strength of 2.0 g/d or more.

The hollow polyester filaments of the present invention can be either in the form of a continuous multifilament yarn or in the form of staple fibers, and are useful for the preparation of knitted or woven fabrics, nonwoven fabrics and pads. Accordingly, it is also preferable that each of the hollow polyester filaments has a denier of 10 or less (a dtex of 11.1 or less). Fabrics made from such hollow polyester filament can be used for clothes or filters. Each of the hollow polyester filaments of the present invention has a large number of fine pores through which the hollow is connected to the atmosphere outside of the filament. That is, each of the polyester filaments has a very large internal surface and a large number of capillaries which are effective for absorbing water or moisture. Accordingly, the hollow polyester filaments of the present invention preferably have a water absorbing rate of at least 120 seconds per 0.04 ml of water, which is determined by a method to be explained hereinafter. Also, it is preferable that the hollow polyester filaments of the present invention have an absorption of at least 50%, which is determined by another method as described hereinafter.

The hollow polyester filaments of the present invention can contain any conventional additives, for example, catalyst, anti-discoloring agent, thermostabilizing agent, optical brightening agent, flame-retarding agent, delusterant; dye; pigment and other inert additives, insofar as such additives do not cause the water absorbing property of the filaments to be decreased. The hollow polyester filaments can also contain a residual amount of a pore-forming agent which will be explained hereinafter.

The hollow polyester filaments of the present invention can be produced by using the process of the present invention. In the process, a molten blend of a polyester containing at least 90% by molar amount of recurring units of the formula (I):

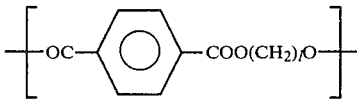

(I)

where l represents an integer of from 2 to 6, and a pore-forming agent consisting of at least one organic sulfate compound of the formula (III):

$$R'SO_3M' \quad \text{(III)}$$

wherein R' represents a member selected from the group consisting of alkyl radicals having 3 to 30 carbon atoms, aryl radicals having 7 to 40 carbon atoms and alkylaryl radicals having 7 to 40 carbon atoms, and M' represents a member selected from a group consisting of alkali metals and alkaline earth metals, is extruded into a hollow filament shape. The resultant hollow filaments are solidified by cooling and then taken up. The extruding, solidifying and taking-up operations can be carried out in accordance with an conventional melt-spinning process which is suitable for producing the conventional hollow polyester filaments. The taken-up hollow polyester filaments can be drawn at a desired draw ratio by any known drawing process usable for the conventional polyester filaments. During the extrusion, the pore-forming agent is uniformly distributed in the molten polyester matrix, and the distributed particles of the pore-forming agent are extended approximately in the direction of extrusion. Next, during the drawing operation, not only the polyester matrix but also the distributed particles of the pore-forming agent are drawn along the longitudinal axis of the filament.

The resultant hollow polyester filaments are subjected to a treatment with an alkali aqueous solution. This alkali treatment causes at least a portion of the pore-forming agent present in the filaments to be removed therefrom. The removal of the pore-forming agent results in the formation of a number of fine pores uniformly distributed in the filament and extending approximately in parallel to the longitudinal axis of the filament. Portions of the fine pores thus formed are connected to each other. Therefore, the hollow in the filament can be connected to the atmosphere outside of the filament through the interconnected fine pores.

In the organic sulfonate compound of the formula (III), when R' represents an alkyl radical or an alkylaryl radical, the alkyl radical or the alkyl group in the alkylaryl radical may be either a straight chain radical or group or a branched chain radical or group. From the point of view of maintaining compatability of the polyester matrix with the pore-forming agent, it is preferable that R' be an alkyl group having 3 to 30 carbon atoms. M' can be selected from alkali metals such as sodium, potassium and lithium and alkaline earth metals such as magnesium and calcium. The preferable metal for M' is sodium or potassium. The pore-forming agent may consist of either an organic sulfonate compound alone or a mixture of two or more different organic sulfonate compounds.

The organic sulfonate compound usable for the present invention may be selected from aliphatic sulfonate compounds, for example, sodium stearic sulfonate, sodium octylsulfonate, sodium dodecylsulfonate and mixtures of sodium alkyl sulfonates having an average number of 14 carbon atoms, aromatic sulfonate compounds, for example, sodium naphthalene sulfonate, and alkylaryl sulfonate compounds, for example, sodium nonyl benzene sulfonate, sodium dodecylbenzene sulfonate, sodium octadecylbenzene sulfonate, sodium nonylnaphthalene sulfonate and sodium dodecylbenzene disulfonate.

In connection with the pore-forming agent of the polyester filaments, it should be noted that, when a polyalkylene glycol is used as the pore-forming agent and the resultant polyester filaments are treated with an alkali aqueous solution to an extent that the alkali-treated polyester filaments exhibit a water absorbing property, the polyester filaments also exhibit such a poor mechanical strength that the filaments are useless for practical use. Moreover, if the alkali treatment is carried out to an extent that the resultant filaments exhibit a mechanical strength high enough for the practical use, the filaments also will exhibit such a poor water absorbing property that the filaments can not attain the objects of the present invention. Accordingly, the pore-forming agent for the present invention should not contain the polyalkylene glycol.

In the preparation of the blend of the polyester and the pore-forming agent, it is preferable that the amount of the pore-forming agent be in a range of from 0.01 to 40%, more preferably, from 0.1 to 30%, based on the weight of the polyester. An amount of the pore-forming agent which is less than 0.01% will cause the hollow polyester filaments of the present invention to have a poor water absorbing property. Also, an amount of the pore-forming agent which is more than 40% will cause difficulty in the operation of blending the polyester uniformly with the pore-forming agent and in the melt-spinning operation of the molten blend.

Usually, it is preferably that the pore-forming agent be blended into the polyester prior to the melt-spinning operation. For example, the polyester may be prepared from the component monomers in the presence of the pore-forming agent. That is, the pore-forming agent may be added either to the ester-producing mixture or to the condensation mixture. However, it is possible to blend the pore-forming agent into the polyester by using an extruder and to subject the blend to another extruder for performing the melt-spinning operation. Also, it is possible to blend the pore-forming agent directly with the polyester in an extruder for the melt-spinning operation.

The molten blend is extruded through a spinneret having a plurality of spinning orifices suitable for forming the hollow filaments. Usually, the spinning orifice has a horseshoe-shaped opening through which the molten blend is extruded.

The pore-forming agent contained in the hollow polyester filaments can be removed by using any alkali aqueous solutions which are capable of dissolving the pore-forming agent. The removing operation may be applied to the hollow polyester filaments before or after the filaments are converted into a woven or knitted fabric or a pad. However, it is preferable that the removing operation be carried out by treating the hollow polyester filaments with the alkali aqueous solution at an elevated temperature. This alkali treatment is effective not only for readily dissolving away the pore-forming agent but also for dissolving away a portion of the polyester matrix from the filaments, so as to form a number of pores in the filaments. The alkali may be selected from the group consisting of sodium hydroxide, potassium hydroxide, tetramethylammonium hydroxide, sodium carbonate and potassium carbonate. A preferable alkali aqueous solution should contain at least one member selected from the group consisting of sodium hydroxide and potassium hydroxide.

The concentration of the alkali in the alkali aqueous solution is adjusted depending upon the type of the alkali compound used and the method for applying the alkali aqueous solution to the hollow polyester filaments. Usually, the concentration of the alkali in the alkali aqueous solution is preferably in a range of from 0.5 to 50% by weight, more preferably, from 0.5 to 25% by weight. Also, it is preferable that the alkali treatment be carried out at a temperature of from 60° to 130° C., more preferably, from 60° to 100° C., for one minute to 4 hours.

The pore-forming agent in the hollow polyester filaments may be removed either completely or partially in response to the amount of the pore-forming agent contained in the filaments and to the desired level of the water-absorbing property exhibited by the resultant filaments. However, it is preferable that at least 10% by weight of the amount of the pore-forming agent contained in the hollow polyester filaments be removed from the filaments. The removal of the pore-forming agent results in the formation of fine pores which are uniformly distributed in each filament and which extend approximately in parallel to the longitudinal axis of each filament. At least some portions of the fine pores are connected to each other so as to cause each hollow to be connected to the atmosphere outside of each filament through the fine pores. These fine pores are very effective for promoting the water and moisture absorbing property of the hollow polyester filaments.

The alkali treatment also causes the polyester per se to be partially dissolved in the alkali aqueous solution. That is, the alkali treatment preferably results in a decrease of from 4 to 30%, more preferably, from 7 to 20%, in the weight of the hollow polyester filaments. This partial removal of the polyester from the hollow polyester filaments is effective for softening and smoothing the touch of the hollow polyester filaments. The alkali-treated hollow polyester filaments exhibit a silk-like touch and appearance.

The present invention will be further illustrated by the following examples, which are provided for the purpose of illustration and should not be interpreted as in any way limiting the scope of the present invention. In the examples, all parts and percentages are indicated by weight unless otherwise noted.

The water-absorbing rate of the hollow polyester filaments of the present invention and its durability were determined in accordance with the following method (JIS-L1018).

A knitted filament fabric having a weight of 50 to 200 g/m$^2$ was prepared from the hollow polyester filaments. 0.04 ml of water was dropped down from a location of 1 cm above a horizontal surface of the knitted fabric to the horizontal surface, and then allowed to penetrate into the knitted fabric. The time, in seconds, from the dropping of water up to a stage at which the water completely penetrates into the knitted fabric such that no reflection of visible light from the water on the horizontal surface of the knitted fabric can be observed, was measured. The water-absorbing rate of the filaments is expressed in terms of the above measured time, i.e., seconds per 0.04 ml of water.

The durability of the water-absorbing rate of the hollow polyester filaments was determined by comparing the water-absorbing rate of the hollow polyester filaments which have not yet been laundered with the rate of those which have been laundered in an aqueous solution of 0.3% by weight of a detergent consisting of an anionic soapless soap (Zab, a trademark, made by Kao Soap, Japan) at a temperature of 40° C. for 30 minutes, by using a home electric washing machine. The laundering operation was carried out once or for a desired number of times, for example, ten times.

The percentage of water absorption of the hollow polyester filaments was determined by using the following method.

A mass of hollow polyester filaments, for example, knitted or woven fabric, was completely dried at room temperature for 24 hours and the dry weight ($W_1$) of the mass was measured. The dry filament mass was immersed in water at room temperature for at least 30 minutes. The water-wetted filament mass was centrifugalized by using a centrifuge with a rotable cylindrical basket having a diameter of 17 cm at a revolution rate of 1730 r.p.m. for 5 minutes. The weight ($W_2$) of the centrifugalized filament mass was measured. The percentage of water absorption of the filament mass was calculated in accordance with the equation:

$$\text{Water absorption (\%)} = \frac{W_2 - W_1}{W_1} \times 100$$

The decrease in weight of the hollow polyester filaments caused by the alkali treatment was determined by using the following method.

A mass of hollow polyester filaments was completely dried at a temperature of 110° C. for at least 60 minutes, and the dry weight ($W_1$) of the filament mass was measured. The dried filament mass was subjected to an alkali treatment, washed thoroughly with water, and centrifugalized at the same revolution rate as that mentioned above for 5 minutes. The alkali treated filament mass was completely dried by using the same method as described above. The dry weight ($W_3$) of the alkali treated filament mass was measured. The decrease in weight was calculated in accordance with the following equation:

$$\text{Decrease (\%)} = \frac{W_1 - W_3}{W_1} \times 100$$

EXAMPLE 1

A glass flask having a rectification column was charged with 197 parts of dimethyl terephtalate, 124 parts of ethylene glycol and 0.118 parts of calcium acetate monohydrate. The mixture of the above-mentioned compound was subjected to an ester interchange process in accordance with conventional procedures. A theoretical amount of methyl alcohol was distilled from the reaction mixture. Thereafter, the reaction product was placed into a polymerization flask having a rectification column. 0.112 part of trimethyl phosphate as a stabilizing agent and 0.079 part of antimony oxide as a polymerization catalyst were added to the reaction product. The mixture was subjected to a polymerization process at a temperature of 280° C. under an ambient pressure for 30 minutes and, thereafter, under a reduced pressure of 30 mmHg for 15 minutes. Thereafter, the pressure of the polymerization system was allowed to return to the ambient pressure, and 10 parts of a mixture of sodium alkylsulfonates, wherein the alkyl groups have 8 to 20 carbon atoms and wherein an average number of the carbon atoms in the alkyl groups is about 14, were added to the polymerization mixture. Next, the polymerization mixture was subjected to an additional reaction process for 80 minutes in which the pressure of the polymerization pressure was gradually reduced into a final pressure of 0.32 mmHg while continuously stirring the mixture.

The resultant polyester in an amount of about 200 parts had a limiting viscosity number of 0.622. The polyester was pelletized and dried by using a conventional pelletizer and dryer.

The dried polyester pellets were subjected to a conventional melt-spinning process wherein each of the spinning orifices had a horseshoe-shaped opening having a width of 0.05 mm and a diameter of 0.6 mm. An undrawn hollow polyester multifilament yarn having a yarn count of 300 denier/36 filaments was obtained. In each individual filament, a single hollow extends along the longitudinal axis of the filament. The ratio of the outside diameter of the filament to the diameter of the hollow was 2:1, and the ratio of the cross-sectional area of the hollow to the entire cross-sectional area of the filament including the hollow was 25%. The undrawn filament yarn was drawn at a draw ratio of 4.2 by using a conventional drawing apparatus. The resultant drawn filament yarn had a yarn count of 71 denier/36 filaments.

The multifilament yarn was converted into a knitted fabric. The knitted fabric was scoured and then, dried in accordance with conventional methods.

The dried knitted fabric was treated with an aqueous solution of 0.5% of sodium hydroxide at a boiling temperature thereof for 60 minutes so as to form numerous fine pores evenly distributed in each individual filament. Each of the individual filaments in the alkali-treated knitted fabric had a cross-sectional profile as shown in FIG. 1 and a peripheral surface as shown in FIG. 2.

The properties of the alkali-treated hollow polyester filaments are shown in Table 1.

EXAMPLES 2 through 4

In each of Examples 2 through 4, the same procedures as those mentioned in Example 1 were carried out, except that the amount of the sodium alkylsulfonate mixture used was 2.5% and the alkali treatment was carried out for a time period as shown in Table 1 at the boiling temperature of the alkali solution. The results are shown in Table 1.

EXAMPLE 5

The same procedures for preparing polyethylene terephthalate as those mentioned in Example 1 were carried out, except that the mixture of sodium alkylsulfonates was not added to the polymerization mixture and the resultant polyethylene terephthalate had a limiting viscosity number of 0.64.

100 parts of the polyethylene terephthalate and 3 parts of the same mixture of sodium alkylsulfonates as that mentioned in Example 1 were mixed together by using a screw type melt extruder at a temperature of 290° C., and the extruded molten mixture was pelletized. The resultant pellets were subjected to the same melt-spinning process and drawing process as those mentioned in Example 1. A hollow polyester multifilament yarn having a yarn count of 69 denier/36 filaments was obtained. The multifilament yarn was converted into a knitted fabric and then treated with an aqueous solution of 0.5% sodium hydroxide at the boiling temperature thereof for 60 minutes. The results are shown in Table 1.

COMPARISON EXAMPLE 1

The same procedure as those mentioned in Example 1 were carried out, except that no alkali treatment was applied to the knitted fabric. The results are shown in Table 1.

COMPARISON EXAMPLE 2

The same procedures as those mentioned in Example 2 were carried out, except that no alkali treatment was applied to the knitted fabric. The results are shown in Table 1.

COMPARISON EXAMPLE 3

The same procedures as those mentioned in Example 5 were carried out, except that no alkali treatment was applied to the knitted fabric. The results are shown in Table 1.

TABLE 1

| Example No. | Content of pore-forming agent (%) | Alkali treating time (min) | Decrease in weight due to alkali treatment (%) | Water absorbing rate (sec) | | | Water absorption (%) | Tensile strength (g/d) | Ultimate elongation (%) |
|---|---|---|---|---|---|---|---|---|---|
| | | | | Before laundering | After one laundering | After ten launderings | | | |
| Example | | | | | | | | | |
| 1 | 5 | 60 | 12 | 2 | 3 | 3 | 120 | 3.22 | 25.6 |
| 2 | 2.5 | 30 | 4 | 2 | 5 | 6 | 80 | 3.64 | 28.7 |

TABLE 1-continued

| Example No. | Content of pore-forming agent (%) | Alkali treating time (min) | Decrease in weight due to alkali treatment (%) | Water absorbing rate (sec) Before laundering | After one laundering | After ten launderings | Water absorption (%) | Tensile strength (g/d) | Ultimate elongation (%) |
|---|---|---|---|---|---|---|---|---|---|
| 3 | 2.5 | 60 | 6 | 2 | 4 | 4 | 95 | 3.51 | 28.4 |
| 4 | 2.5 | 180 | 18 | 2 | 3 | 3 | 110 | 2.78 | 26.8 |
| 5 | 3 | 60 | 4 | 2 | 7 | 7 | 105 | 3.59 | 27.4 |
| Comparison Example | | | | | | | | | |
| 1 | 5 | — | — | 6 | 190 | 600< | 33 | 4.13 | 26.8 |
| 2 | 2.5 | — | — | 7 | 250 | 600< | 33 | 4.18 | 24.7 |
| 3 | 3 | — | — | 5 | 320 | 600< | 33 | 4.09 | 29.6 |

EXAMPLES 6 and 7

In each of Examples 6 and 7, the same procedures as those mentioned in Example 1 were carried out, except that the amount of the sodium alkylsulfonate mixture used was 2 parts (1%), the concentration of sodium hydroxide in the alkali aqueous solution was 1% and the alkali treatment was conducted for the time period mentioned in Table 2. The results are shown in Table 2.

EXAMPLES 8 and 9

In each of Examples 8 and 9, procedures identical to those mentioned in Example 1 were carrioud out, except that 4 parts (2%) of sodium dodecyl benzenesulfonate were used in place of 10 parts (5%) of the sodium alkylsulfonate mixture, the concentration of sodium hydroxide in the alkali aqueous solution was 1%, and the alkali treatment was conducted for the time shown in Table 2. The results are shown in Table 2.

COMPARISON EXAMPLE 4

Procedures idential to those mentioned in Example 1 were carried out, except that each spinning orifice had a circular cross-sectional profile having a diameter of 0.3 mm. The resultant polyester multifilament yarn had a yarn count of 75 denier/36 filaments, and each individual filament had a circular cross-sectional profile. The knitted fabric prepared from the multifilament yarn was scoured and dried by conventional scouring and drying methods, and then treated with an alkali aqueous solution of 0.5% sodium hydroxide at the boiling temperature of the solution for 180 minutes. The results are shown in Table 2.

COMPARISON EXAMPLES 5, 6 and 7

In each of Comparison Examples 5, 6 and 7, procedures identical to those mentioned in Example 1 were carried out, except that 10 parts (5%) of the sodium alkylsulfonate mixture were replaced by a mixture of 2 parts of the sodium alkylsulfonate mixture and 10 parts of polyethylene glycol in Comparison Example 5, a mixture of 4 parts of the sodium alkylsulfonate mixture and 8 parts of polyethylene glycol in Comparison Example 6, and 12 parts of polyethylene glycol in Comparison Example 7. The resultant polyester multifilament yarn had a yarn count of 71 denier/36 filaments. The results are shown in Table 2.

The electron microscope views of the cross-sectional profile and the peripheral surface of the hollow polyester filaments of Comparison Examples 5, 6 and 7 are respectively shown in FIGS. 3 and 4, FIGS. 5 and 6, and FIGS. 7 and 8 of the accompanying drawings.

EXAMPLE 10

Polymerization procedures identical to those mentioned in Example 1 were carried out except that 180 parts of 1.4-butane-diol were used in place of 124 parts of ethylene glycol; 0.1 part of titanium tetrabutoxide was added to the reaction mixture; no calcium actate, trimethyl phosphate or antimony oxide was used; the polymerization was carried out at a temperature of 245° C.; and the sodium alkylsulfonate mixture was used in an amount of 4.5 parts (2%). The resultant polybutylene terephthalate had a limiting viscosity number of 1.04.

The same pelletizing process, melt-spinning process and drawing process as those mentioned in Example 1 were carried out, except that the draw ratio was 4.0 and the resultant drawn multifilament yarn had a yarn count of 71 denier/36 filaments. The multifilament yarn was converted into a knitted fabric, the fabric was scoured and dried by the same methods as those mentioned in Example 1. The knitted fabric was then alkali-treated with an aqueous solution of 2% sodium hydroxide at the boiling temperature of the solution for 240 minutes. The results are shown in Table 2.

TABLE 2

| Example No. | Pore-forming agent Type | Amount (%) | Alkali treatment Concentration of NaOH (%) | Time (min) | Decrease in weight (%) | Water absorbing rate (sec) Before laundering | After one laundering | After ten launderings | Water absorption (%) | Tensile strength (g/d) | Ultimate elongation (%) | Cross-sectional profile |
|---|---|---|---|---|---|---|---|---|---|---|---|---|
| Example 6 | Na-alkylsulfonate mixture | 1 | 1 | 70 | 5 | 2 | 4 | 5 | 85 | 3.84 | 26.5 | Hollow round |
| 7 | Na-alkylsulfonate mixture | 1 | 1 | 120 | 11 | 2 | 3 | 4 | 100 | 3.25 | 24.9 | Hollow round |
| 8 | Na-dodecyl benzene sulfonate | 2 | 1 | 140 | 7 | 2 | 4 | 4 | 90 | 3.84 | 26.7 | Hollow round |

TABLE 2-continued

| Example No. | Pore-forming agent Type | Pore-forming agent Amount (%) | Alkali treatment Concentration of NaOH (%) | Alkali treatment Time (min) | Alkali treatment Decrease in weight (%) | Water absorbing rate (sec) Before laundering | Water absorbing rate (sec) After one laundering | Water absorbing rate (sec) After ten laundrings | Water absorption (%) | Tensile strength (g/d) | Ultimate elongation (%) | Cross-sectional profile |
|---|---|---|---|---|---|---|---|---|---|---|---|---|
| 9 | Na-dodecyl benzene sulfonate | 2 | 1 | 200 | 14 | 2 | 3 | 3 | 105 | 3.01 | 27.2 | Hollow round |
| 10 | Na-alkyl-sulfonate mixture | 2 | 2 | 240 | 12 | 3 | 6 | 8 | 88 | 3.30 | 27.0 | Hollow round |
| Comparison Example | | | | | | | | | | | | |
| 4 | Na-alkyl-sulfonate mixture | 5 | 0.5 | 180 | 46 | 360 | 600< | 600< | 81 | 1.34 | 25.0 | Solid round |
| 5 | Na-alkyl-sulfonate mixture<br>Poly-ethylene glycol | 1<br>5 | 0.5 | 90 | 14 | 16 | 150 | 315 | 62 | 1.94 | 26.5 | Hollow round (FIG. 3) |
| 6 | Na-alkyl-sulfonate mixture<br>Poly-ethylene glycol | 2<br>4 | 0.5 | 75 | 14 | 15 | 140 | 300 | 60 | 1.65 | 24.0 | Hollow round (FIG. 5) |
| 7 | Poly-ethylene glycol | 6 | 0.5 | 60 | 13 | 22 | 150 | 600< | 58 | 1.69 | 23.8 | Hollow round (FIG. 7) |

EXAMPLE 11

A glass flask having a rectification column was charged with a polymerization mixture consisting of 194 parts of dimethylterephthalate, 124 parts of ethylene glycol, 14.8 parts (5 molar %) of sodium 3,5-di(carbomethoxy)benzene sulfonate, 0.049 part of manganese acetate tetrahydrate and 0.128 part of sodium acetate trihydrate. The polymerization mixture was subjected to an ester interchange process. After a theoretical amount of methyl alcohol was distilled from the polymerization mixture, the reaction product was placed in a polymerization flask having a rectification column and then mixed with 0.029 part of normal phosphoric acid and 0.079 part of antimony trioxide as a polymerization catalyst. The mixture was subjected to a polymerization process at a temperature of 280° C. under an ambient pressure for 30 minutes, under a reduced pressure of 30 mmHg for 15 minutes and then under a reduced pressure of 0.35 mmHg for 20 minutes. Thereafter, the pressure of the polymerization system was allowed to return to ambient pressure, and then 5.76 parts (2.8%) of the same sodium alkylsulfonate mixture as that mentioned in Example 1 were added to the system. The pressure of the polymerization system was gradually reduced while stirring and thereafter maintained under a reduced pressure of 0.30 mmHg at a temperature of 280° C. for 20 minutes for completing the polymerization reaction.

Thereafter, the same procedures as those mentioned in Example 1 were repeated by using the above-obtained polymer. A multifilament yarn having a yarn count of 75 denier/36 filaments was obtained. The individual hollow filaments had a tensile strength of 4.0 g/d and an ultimate elongation of 22.5%. The cross-sectional area of the hollow corresponded to 30% of the entire cross-sectional profile of the filament including the hollow.

The alkali treatment was carried out by using an aqueous solution of 0.5% sodium hydroxide at a temperature of 100° C. for 30 minutes.

The results are shown in Table 3.

EXAMPLE 12

The same procedures as those mentioned in Example 11 were carried out, except that the alkali treatment was conducted for 60 minutes.

The results are shown in Table 3.

TABLE 3

| Example No. | Water absorption rate (sec) Before laundering | Water absorption rate (sec) After one laundering | Water absorption rate (sec) After ten launderings | Water absorption (%) Before laundering | Water absorption (%) After ten launderings |
|---|---|---|---|---|---|
| 11 | 4 | 7 | 2 | 117 | 120 |
| 12 | 2 | 2 | 1 | 131 | 130 |

What we claim is:

1. Hollow water-absorbing polyester filaments, which consist essentially of a polyester having at least 90 molar percent of recurring units of the formula (I):

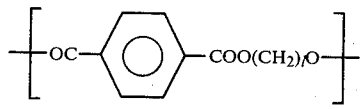

(I)

wherein l represents an integer of 2 to 6, and wherein each of said individual filaments has at least one hollow extending along the longitudinal axis of said filament and a number of pores, having a diameter of from about 0.01 to 1.0 micron, evenly distributed throughout said filament and extending approximately in parallel to the longitudinal axis of said filament, said hollow being connected to the outside of said filament at least through the portions of said pores which are connected to each other and wherein said filaments have a water absorption of at least 50 percent wherein said filaments are produced by;

(a) melt-spinning precursor hollow polyester filaments from a blend of polyester and 0.1 to 30% by weight based on the weight of said polyester of a pore forming agent consisting essentially of at least one organic sulfonate compound of the formula:

$$R'SO_3M' \text{ tm (III)}$$

wherein R' is a member selected from the group consisting of alkyl radicals having 3 to 30 carbon atoms, aryl radicals having 7 to 40 carbon atoms and alkaryl radicals having 7 to 40 carbon atoms; and M' is a member selected from the group consisting of alkali metals and alkaline earth metals, whereby said pore-forming agent is dispersed in the form of particles separate from each other and extending approximately in parallel to the longitudinal axis of said filament, in a matrix consisting of said polyester; and (b) treating said melt-spun precursor hollow filaments with an alkaline aqueous solution to cause at least a portion of said particles of pore-forming agent and portions of said polyester matrix surrounding said particles of pore-forming agent to be removed from said precursor hollow filament and to form said pores in said hollow filament.

2. Polyester filaments as claimed in claim 1, wherein each individual filament has a hollow located in the center portion of said filament.

3. Polyester filaments as claimed in claim 1, wherein said polyester is polyethylene terephthalate.

4. Polyester filaments as claimed in claim 1, wherein said polyester is polybutylene terephthalate.

5. Polyester filaments as claimed in claim 1, wherein said polyester contains, in addition to said recurring units of the formula I, at least one additional moiety of the formula (II):

$$X-\underset{\underset{SO_3M}{|}}{Z}-Y$$

wherein X and Y represent a member selected from the group consisting of a hydrogen atom and $$-\underset{\underset{O}{\|}}{C}-R,\ -\underset{\underset{O}{\|}}{C}-OR,\ -(CH_2)_n-OH,$$

$$-O(CH_2)_n-[O(CH_2)_n]_m-OH \text{ and } -\underset{\underset{O}{\|}}{C}-[O(CH_2)_n]_m-OH$$

groups in which R represents either a hydrogen atom or a lower alkyl radical having 1 to 10 carbon atoms, respectively, when either one of X and Y represents a hydrogen atom, and the other represents an atom other than hydrogen; Z represents either an aromatic hydrocarbon or an aliphatic hydrocarbon; n and m represent an integer, respectively; and M represents either an alkali metal or alkaline earth metal.

6. Polyester filaments as claimed in claim 5, wherein in the formula (II), X and Y represent a group—COOR' wherein R' represents a member selected from the group consisting of a hydrogen atom and methyl and ethyl radicals, respectively; Z represents either a benzene radical or a naphthalene radical; and M represents either a sodium or potassium atom.

7. Polyester filaments as claimed in claim 5, wherein said additional moiety of the formula (II) is present in a molar amount of 10% or less.

8. Polyester filaments as claimed in claim 3, wherein the entire cross-sectional area of said hollow in each individual filament corresponds to 5 to 50% of the entire cross-sectional area of said filament including said hollow.

9. Polyester filaments as claimed in claim 8, wherein the entire cross-sectional area of said hollow in said filament corresponds to 10 to 30% of the entire cross-sectional area of said filament including said hollow.

10. Polyester filaments as claimed in claim 1, wherein pores of said filaments have an average length ranging from 0.01 to 200 microns.

11. Polyester filaments as claimed in claim 1, wherein the total sum of the cross-sectional areas of said pores corresponds to 0.01 to 50% of the cross-sectional area of said filament excluding said hollow.

12. Polyester filaments as claimed in claim 11, wherein the total sum of the cross-sectional areas of said pores corresponds to 0.1 to 30% of the cross-sectional area of said filament excluding said hollow.

13. Polyester filaments as claimed in claim 1, wherein each individual filament has a denier of 10 or less (a dtex of 11.1 or less).

14. Polyester filaments as claimed in claim 1, wherein the tensile strength of each individual filament is 2.0 g/d or more.

15. Polyester filaments as claimed in claim 1, wherein said filaments have a water-absorbing rate of at least 120 second per 0.04 ml of water.

16. A process for producing hollow water-absorbing polyester filaments having a water absorption of at least 50 percent comprising the steps of preparing hollow polyester filaments each having at least one hollow extending along the longitudinal axis of said filament, by melt-spinning a blend of a polyester containing at least 90% by a molar amount of recurring units of the formula (I):

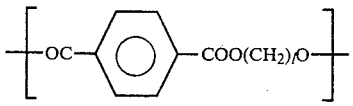

(I)

wherein l represents an integer of from 2 to 6, and 0.1 to 30% by weight based on the weight of said polyester of a pore-forming agent consisting essentially of at least one organic sulfonate compound of the formula (III):

$$R'SO_3M' \qquad \text{(III)}$$

wherein R' represents a member selected from the group consisting of alkyl radicals having 3 to 30 carbon atoms, aryl radicals having 7 to 40 carbon atoms and alkylaryl radicals having 7 to 40 carbon atoms, and M' represents a member selected from the group consisting of alkali metals and alkaline earth metals, whereby said pore-forming agent is dispersed in the form of particles separate from each other and extending approximately in parallel to the longitudinal axis of said filament, in a matrix consisting of said polyester; and treating said melt-spun hollow polyester filaments with an alkaline aqueous solution to cause at least a portion of said particles of pore-forming agent and portions of said polyester matrix surrounding said particles of pore-forming agent to be removed from said precursor hollow filament and thereby creating a number of fine pores having a diameter of from about 0.01 to 1.0 micron which are evenly distributed throughout said filament and extending approximately in parallel to the longitudinal axis of said filament, and to cause said hollow to be connected to the outside of said filament at least through the portions of said fine pores which are connected to each other.

17. A process as claimed in claim 16, wherein said polyester contains, in addition to said recurring units of the formula I, at least one additional moiety of the formula (II):

$$\begin{array}{c} X-Z-Y \\ | \\ SO_3M \end{array} \qquad \text{(II)}$$

wherein X and Y represent a member selected from the group consisting of a hydrogen atom and the groups of $$-\underset{\underset{O}{\|}}{C}-R,\ -\underset{\underset{O}{\|}}{C}-OR,\ -(CH_2)_n-OH,$$

$$-O(CH_2)_n-[O(CH_2)_n]_m-OH \text{ and } -\underset{\underset{O}{\|}}{C}-[O(CH_2)_n]_m-OH$$

wherein R represents either a hydrogen atom or a lower alkyl radical having 1 to 10 carbon atoms, respectively, when either one of X and Y represents a hydrogen atom and the other represents one of the above-mentioned groups; Z represents either an aromatic hydrocarbon or an aliphatic hydrocarbon; n and m represent an integer, respectively; and M represents either an alkali metal or alkaline earth metal.

18. A process as claimed in claim 17, wherein said additional moiety of the formula (II) is present in a molar amount of 10% or less.

19. A process as claimed in claim 16, wherein in the formula (III), R′ represents an alkyl radical having 3 to 30 carbon atoms and M′ represents either a sodium or potassium atom.

20. A process as claimed in claim 16, wherein said alkali aqueous solution contains at least one member selected from the group consisting of sodium hydroxide and potassium hydroxide.

21. A process as claimed in claim 16, wherein said removing operation is carried out at a temperature of from 60° to 130° C.

22. A process as claimed in claim 16, wherein the concentration of the alkali in said aqueous solution is in a range of from 0.5 to 50% by weight.

23. A process as claimed in claim 16, wherein said removing operation results in a decrease of from 4 to 30% in the weight of said filaments.

24. A process as claimed in claim 23, wherein the decrease in the weight of said filaments is in a range of from 7 to 25%.

25. A process as claimed in claim 16, wherein said removing operation results in the removal of at least 10% by weight of the amount of said pore-forming agent from said filaments.

* * * * *